US008240111B2

(12) United States Patent
Feigl

(10) Patent No.: US 8,240,111 B2
(45) Date of Patent: Aug. 14, 2012

(54) HOLDING DEVICE FOR A BALUSTRADE

(76) Inventor: Bernhard Feigl, Lochau (AT)

( * ) Notice: Subject to any disclaimer, the term of this patent is extended or adjusted under 35 U.S.C. 154(b) by 244 days.

(21) Appl. No.: 12/592,818

(22) Filed: Dec. 3, 2009

(65) Prior Publication Data

US 2010/0154335 A1 Jun. 24, 2010

(30) Foreign Application Priority Data

Dec. 5, 2008 (EP) ..... 08021182

(51) Int. Cl.
*E04C 3/00* (2006.01)

(52) U.S. Cl. ..... 52/832; 52/184

(58) Field of Classification Search ..... 52/184.27, 52/182, 186, 235, 832, 764
See application file for complete search history.

(56) References Cited

U.S. PATENT DOCUMENTS 5,853,828 A * 12/1998 Schimmelpenningh et al. ..... 428/34
7,036,799 B2 * 5/2006 Shepherd ..... 256/73
2002/0152713 A1 * 10/2002 Greco ..... 52/720.2
2003/0159376 A1 * 8/2003 Huynh ..... 52/208
2006/0185274 A1 * 8/2006 Merica ..... 52/235
2010/0101915 A1 * 4/2010 Fang et al. ..... 198/321
2011/0219722 A1 * 9/2011 Feigl ..... 52/705

FOREIGN PATENT DOCUMENTS

DE 10338816 B3 5/2005
DE 20 2007 009239 9/2007

* cited by examiner

*Primary Examiner* — Branon Painter
(74) *Attorney, Agent, or Firm* — Pandiscio & Pandiscio

(57) ABSTRACT

A holding device (1) by which one or more panes of glass (2) forming a balustrade (3) is/are supported on a wall (4) or ceiling (5), consisting of a carrier rail (7) holding or supporting the panes of glass (2) and a holding plate (9) attached to the ceiling (4) or the wall (5), with the carrier rail (7) held in a horizontal direction on the holding plate (9) by means of a U-shaped hook-in pocket (25) projecting from the carrier rail (7). A box rail (11) projecting from the holding plate (9) in the direction of the carrier rail (7) is attached directly or by supporting elements (12), such that the carrier rail (7) is in contact with the box rail (11) or the supporting element (12) in the vertical direction, and one or more setscrews (16) and clamping screws (34) project from the box rail (11) in the direction of the carrier rail (7) with the screws connected to the carrier rail (7), and the distance between the box section (11) and the carrier rail (7) can be varied by means of the setscrew(s) (16).

10 Claims, 9 Drawing Sheets

HOLDING DEVICE FOR A BALUSTRADE

Figure 1:
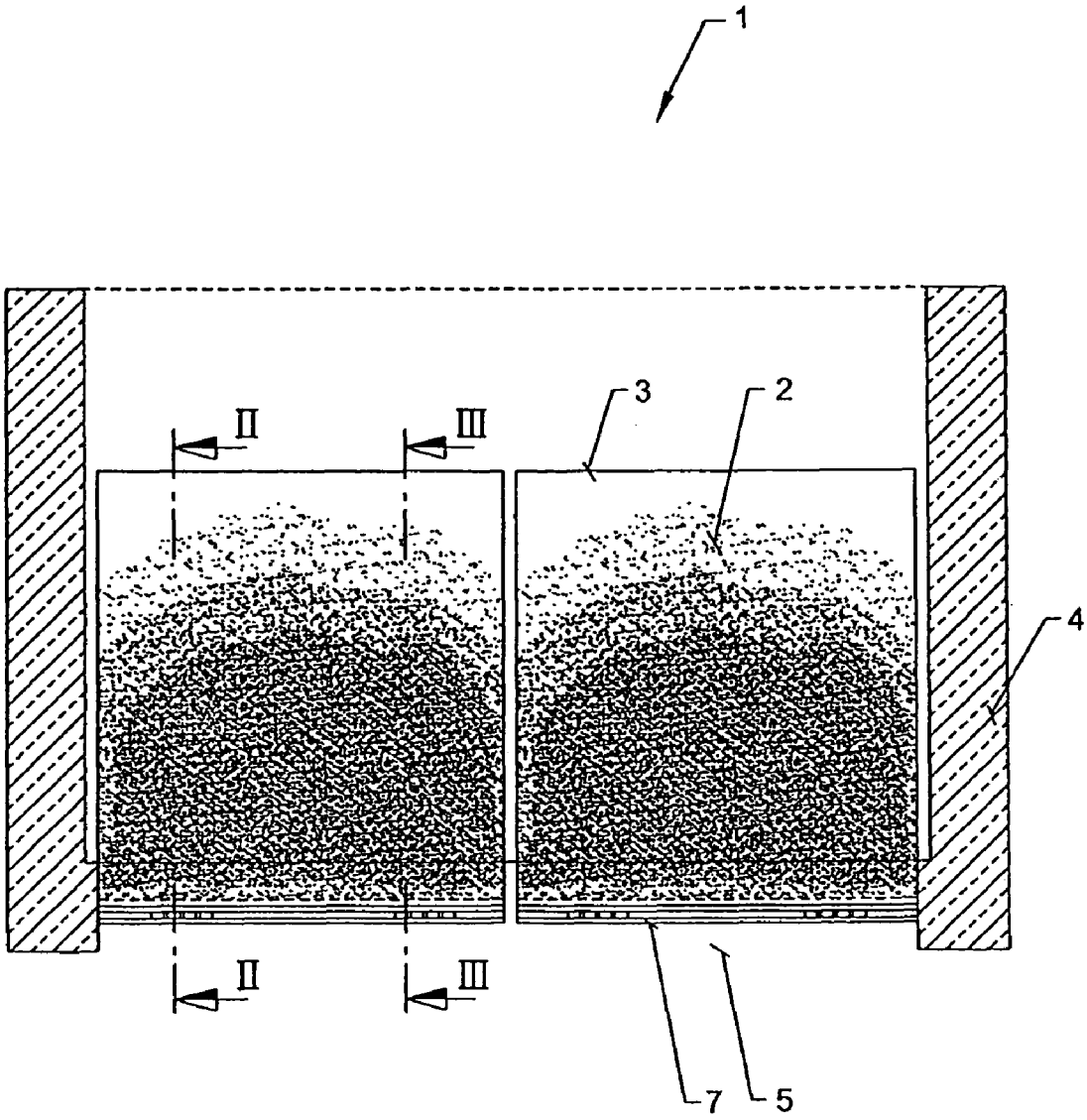

The invention relates to a holding device by means of which one or more panes of glass forming a balustrade is/are supported on a wall or ceiling, in accordance with the pre-characterising clause of patent claim 1.

Holding devices of this kind have been developed by the patent registrant in the recent past; for example, a holding device of this kind is disclosed in DE 103 38 816 B3. In this, the panes of glass forming the balustrade are inserted in a U-section rail and are secured there by means of an adhesive and spacers. A U-shaped hook-in pocket is formed onto the outside of the U-section rail and this pocket is hooked onto a projection that is formed on a base section.

The base section is attached to the ceiling and extends along the entire length of the balustrade. The hook-in pocket and the holding projection formed onto the base section absorb horizontal forces as loose bearings, particularly since an air gap is provided between the horizontal leg of the hook-in pocket and the free end of the holding projection in the installed condition.

The vertical forces exerted by the weight of the balustrade, i.e. the panes of glass, are supported by the base section on the underside of the carrier rail, because this is where a locking mechanism formed as a fixed bearing is provided, by means of which the U-section rail is supported in vertical and horizontal directions.

In order for the U-section rail, and therefore the panes of glass arranged within it, to be set to the perpendicular, there is a plurality of set screws screwed into a threaded hole worked into the fixed bearing of the base section.

The setscrews pass through a fixing plate that is connected to the underside of the U-section rail in a positive connection. When the setscrews are turned, the horizontally acting forces are transferred to the U-section rail in order to change its angle in relation to the base section and the ceiling, with the effect that the angle of the panes of glass and of the U-section rail can be adjusted.

Although holding devices of this kind have proven effective in practise, they are often costly to manufacture because the base section has a complicated design configuration. This is because the base section has to be produced as an extruded section in order to provide a contact surface for the U-section rail that extends along the entire length of the balustrade. In some structures and applications, however, it has become apparent that the complicated design configuration of the base section according to DE 103 38 816 B3 is not necessarily required.

It is therefore a task of the present invention to develop a holding device of the aforementioned kind by means of which a reliable support for the balustrade on the wall or ceiling is provided, but with minimised manufacturing costs.

This purpose is achieved by the features that are listed in the characterising part of patent claim 1.

Other advantageous further embodiments of the invention are disclosed in the subordinate claims.

The design configuration of the main plate that is attached directly to the wall or ceiling can be manufactured in a straightforward manner because the setscrew is now supported in a box rail configured as an individual component and the box rail can be connected to the holding plate either directly or via a support element. Complicated, and therefore expensive, shaped add-ons in order to allow the setscrew to be secured, by means of which the angle of the carrier rail configured as a U-section rail, are thus dispensed with.

On the side next to each setscrew, there is a clamping screw which is, firstly, screwed into the box rail and a nut that is held in a non-positive connection in the box rail and, secondly, in contact with the outside of the carrier rail by means of the head formed on the clamping screw. As a result, the carrier rail is supported on the box rail by means of the setscrew and clamping screw; this mechanical fixing method allows horizontally vectored forces and their turning forces that act on the balustrade to be absorbed.

Furthermore, a strip or individual holding blocks can be formed onto the upwardly projecting end face of the holding plate in accordance with the given situation of the structure, in order to adapt the suspension of the carrier rail on the holding plate to these given conditions.

In addition, it is possible to decide during installation at which positions the carrier rail will be supported on the holding plate by means of the setscrews and clamping screws, because the box rails can also be connected to the holding plate in certain areas, with the effect that they do not have to run along the entire length of the carrier rail.

Figure 2:
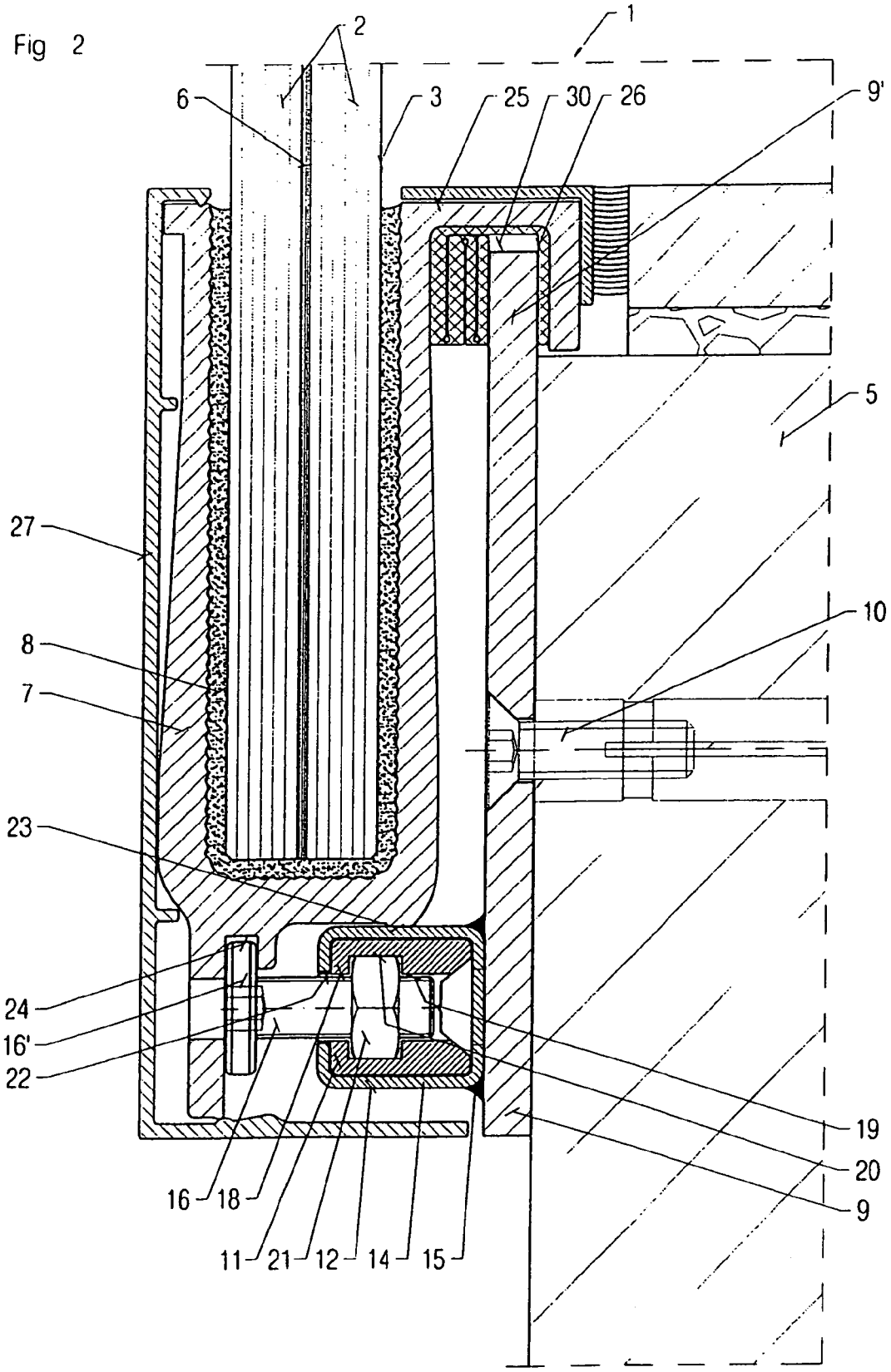
Figure 3:
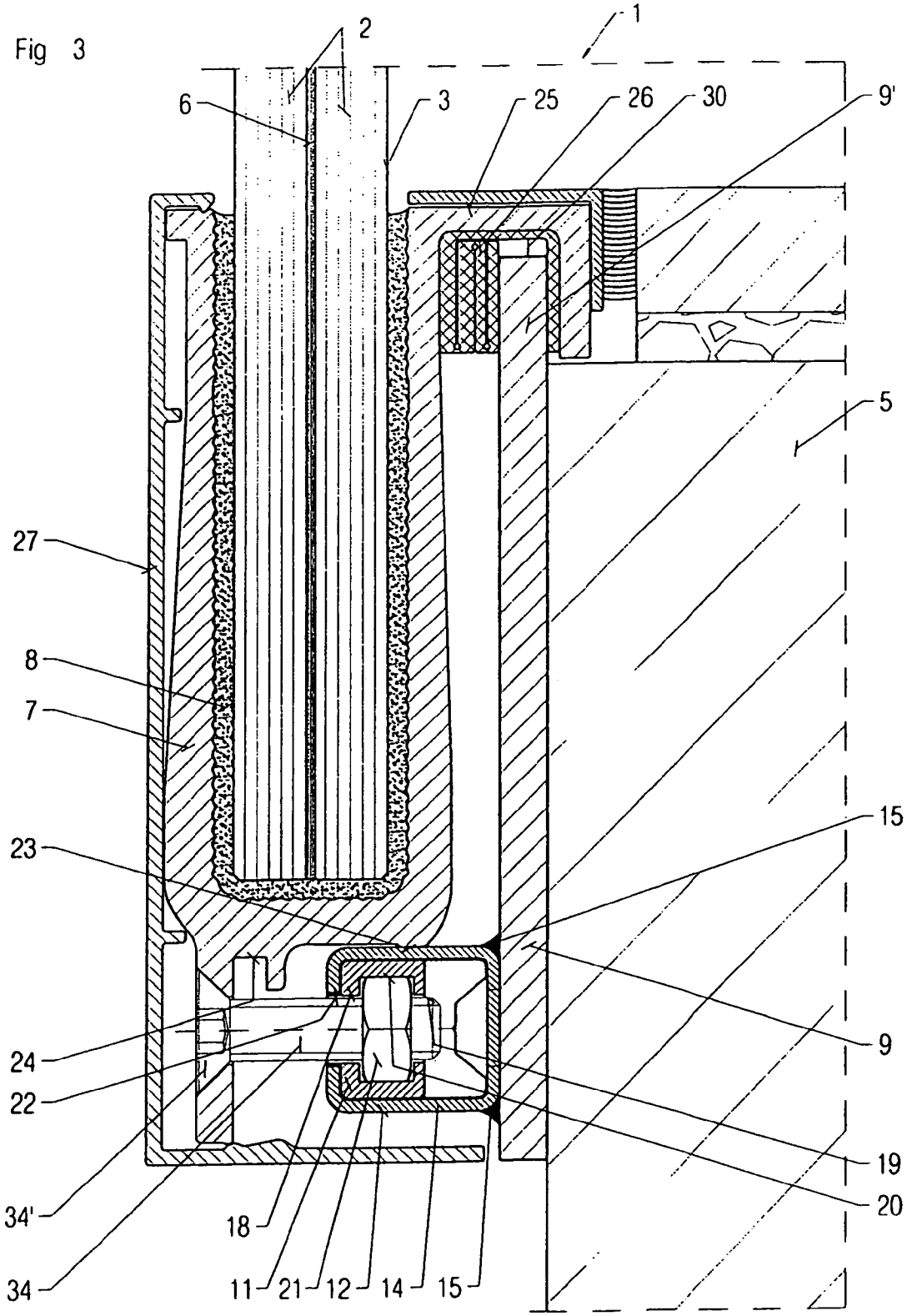
Figure 4A:
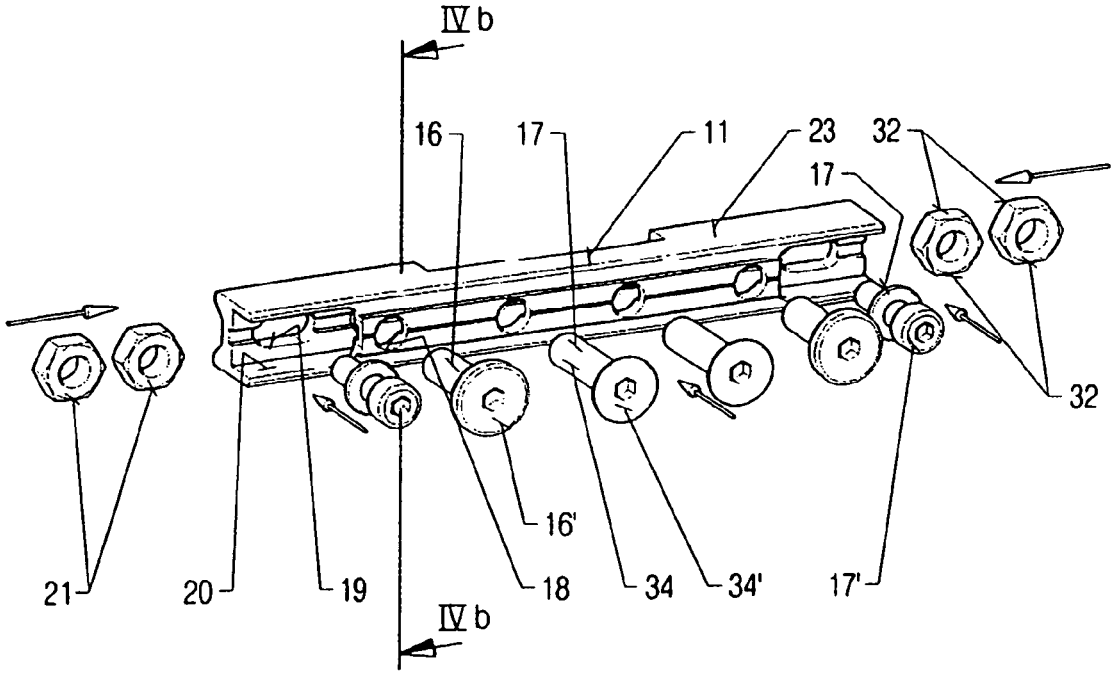
Figure 4B:
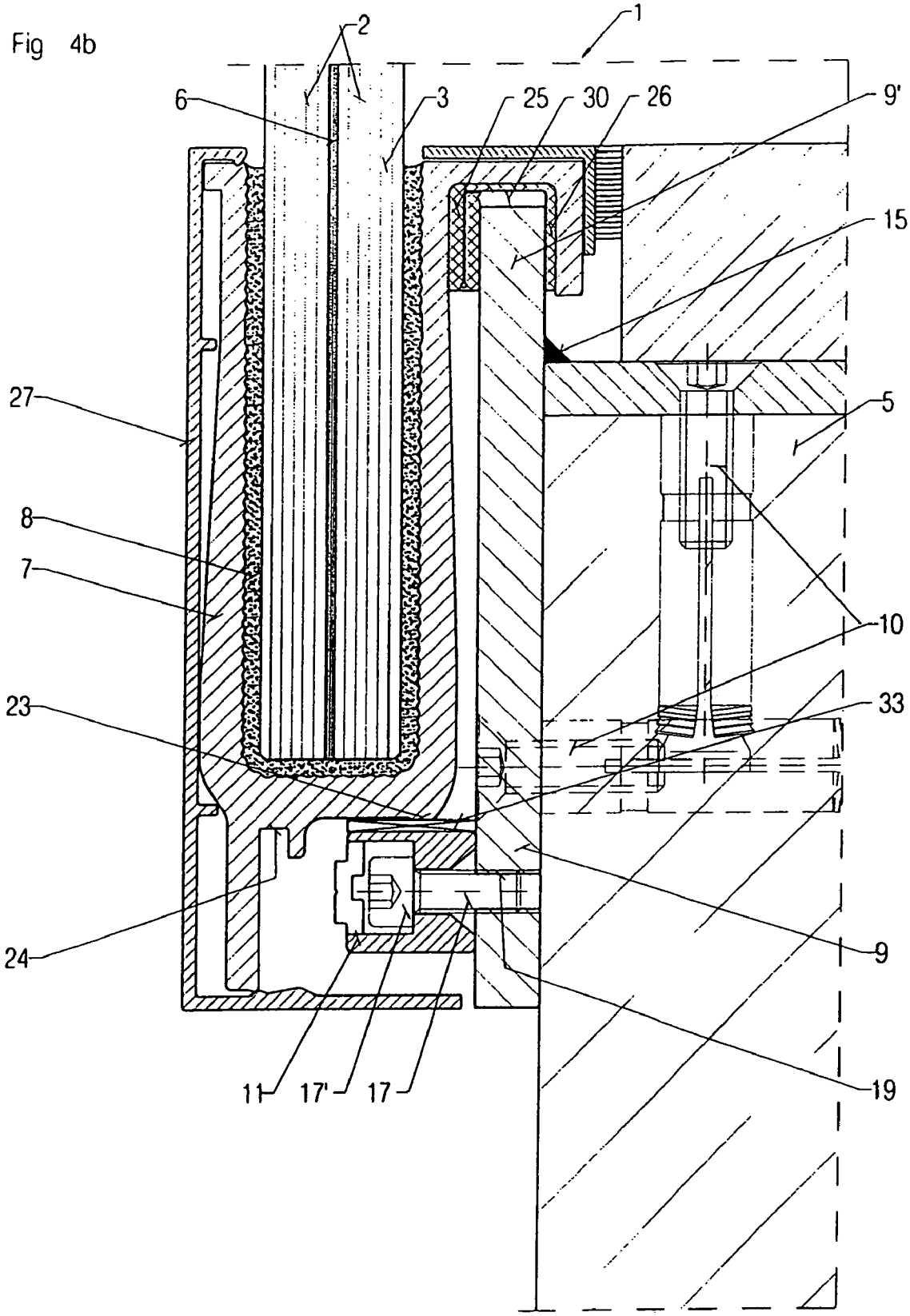
Figure 5A:
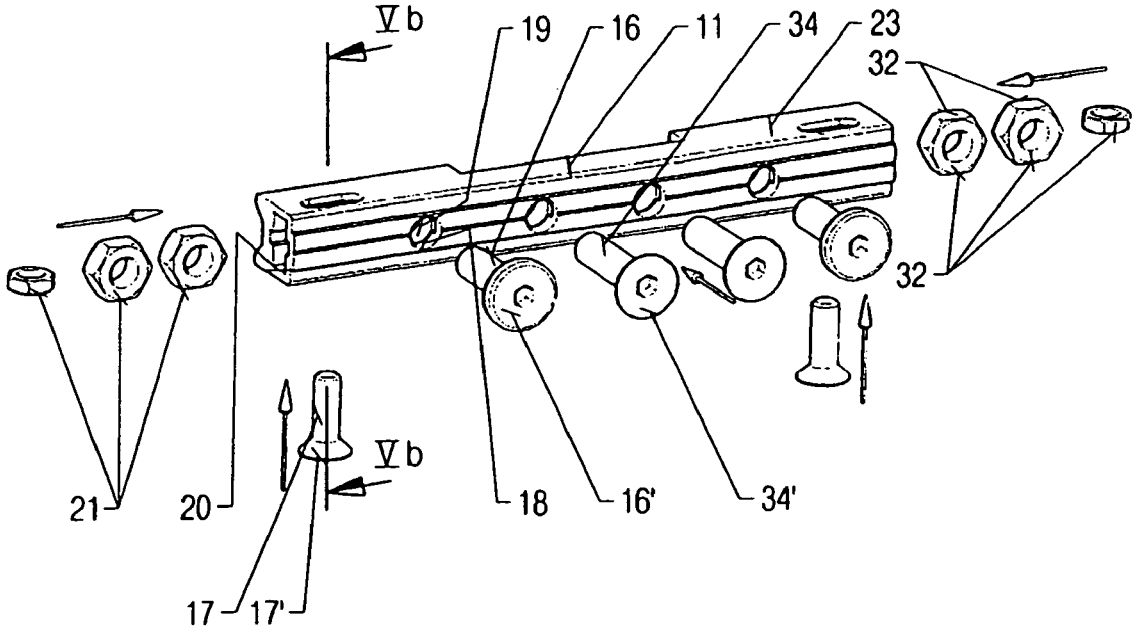
Figure 5B:
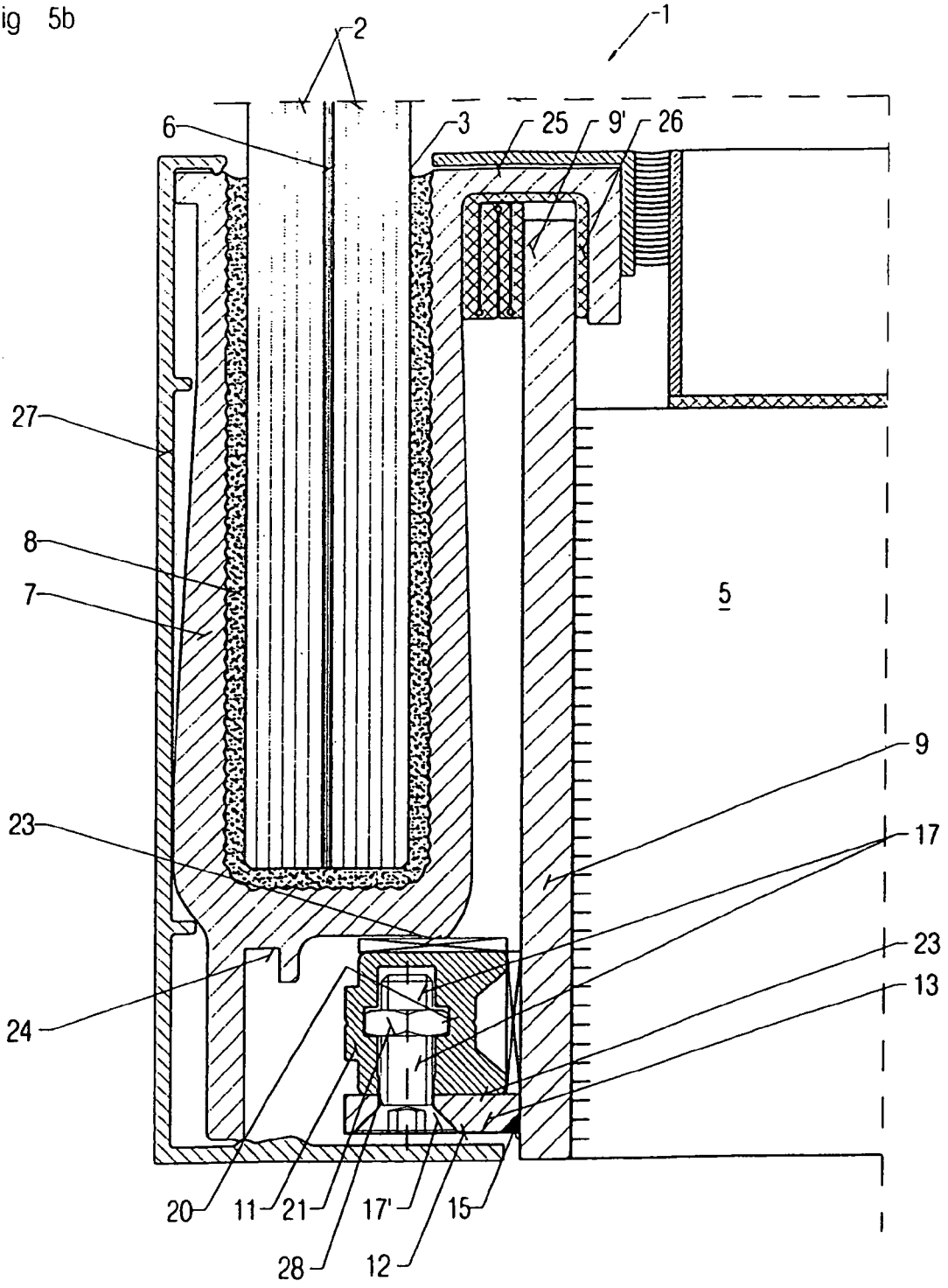
Figure 6:
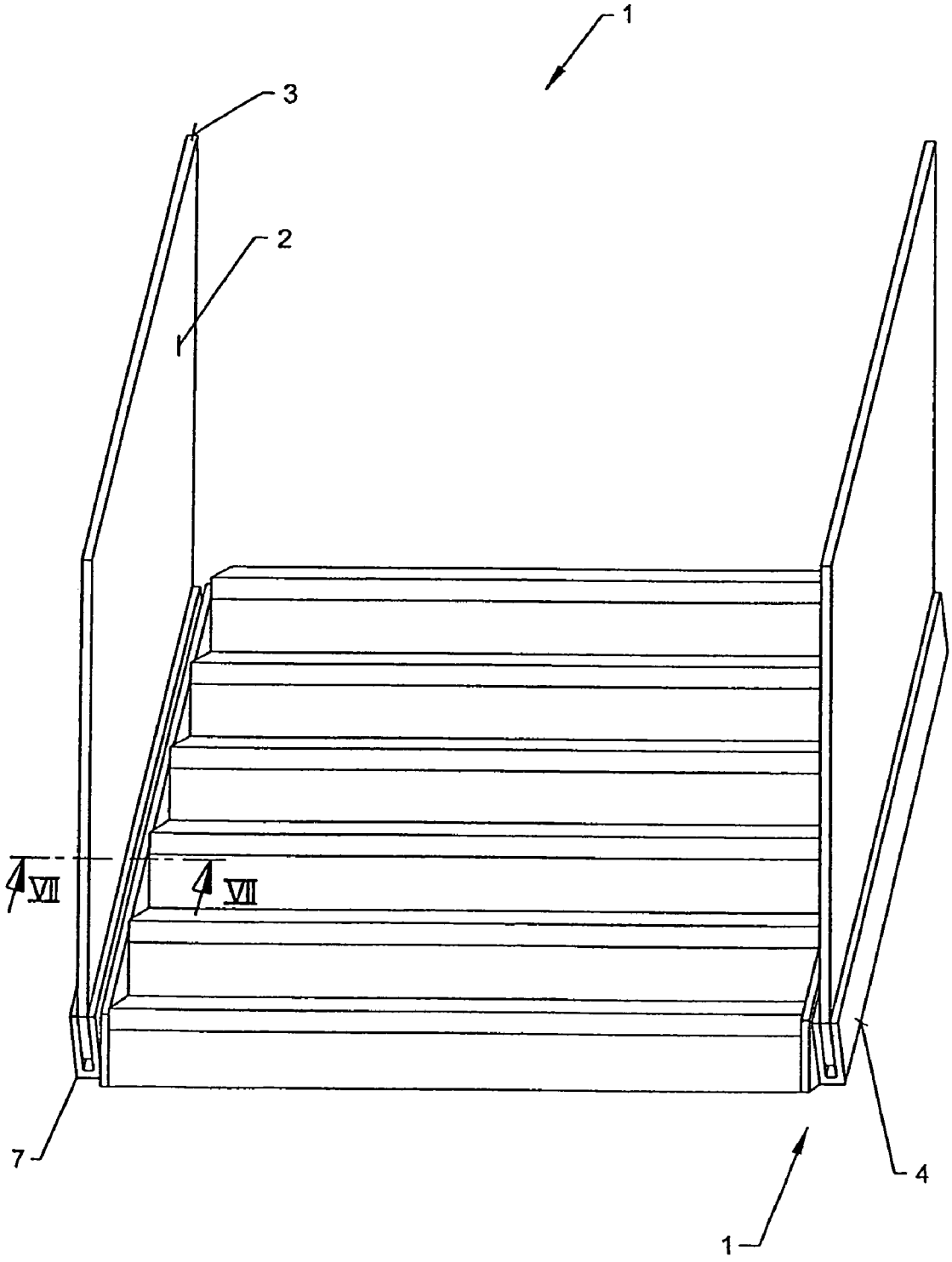
Figure 7:
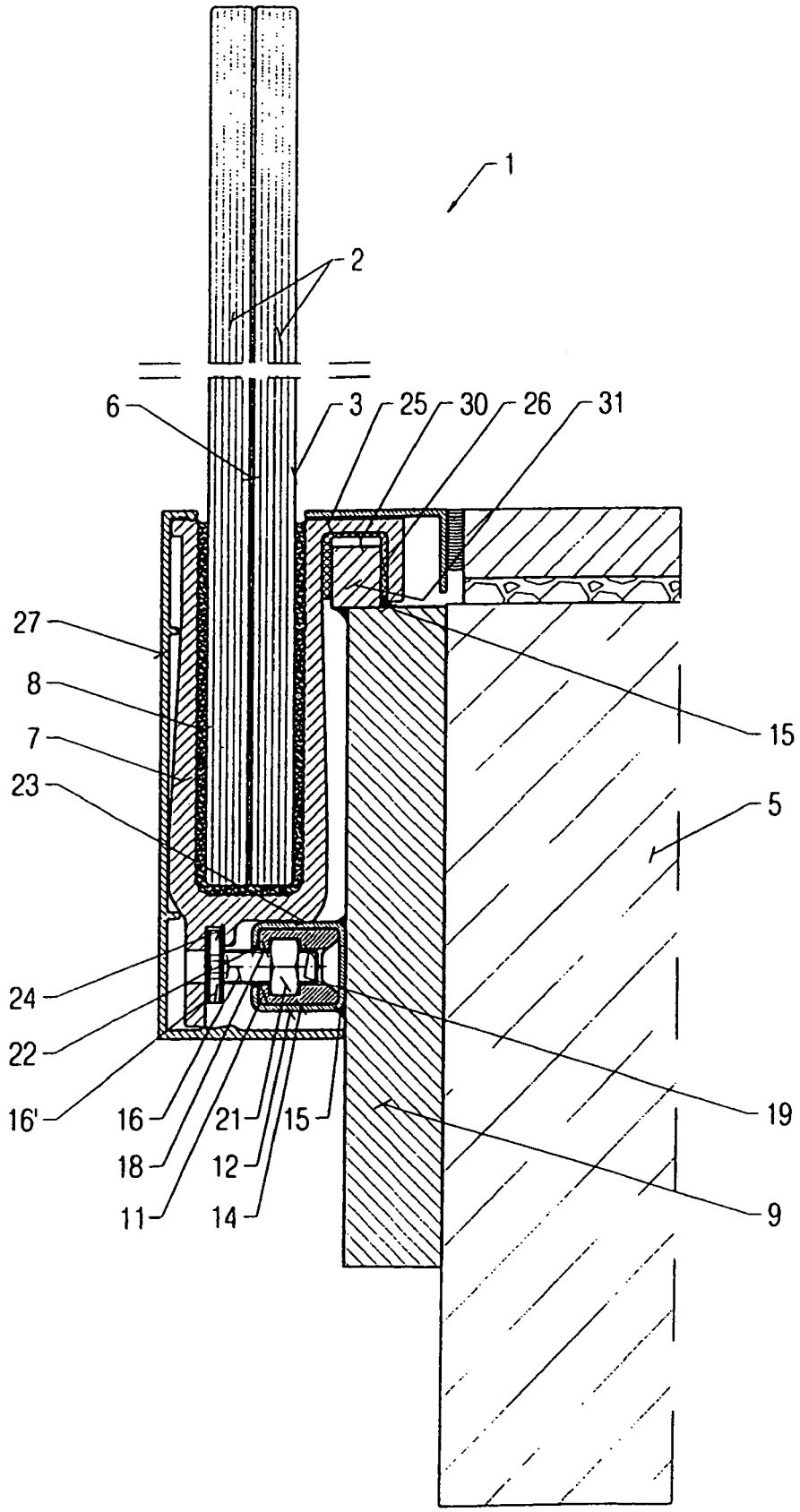

The drawing shows three sample embodiments of a holding device configured in accordance with the present invention, the details of which are explained below. In detail:

FIG. 1 shows a holding device for supporting a balustrade between two walls and on a ceiling, in a front view, FIG. 2 shows an initial sample embodiment of the holding'device in accordance with FIG. 1, along the section II-II, FIG. 3 shows the holding device in accordance with FIG. 2, along the section III-III, FIG. 4*a* shows a second sample embodiment of a holding device in accordance with FIG. 1, in a perspective view, FIG. 4*b* shows the holding device in accordance with FIG. 4*a*, along the section IVb-IVb, FIG. 5*a* shows a third sample embodiment of a holding device, in a perspective view, FIG. 5*b* shows the holding device in accordance with FIG. 5*a*, along the section Vb-Vb, FIG. 6 shows another application for the holding device in accordance with FIG. 2, by means of which a staircase balustrade is secured on a staircase, in a perspective view, FIG. 7 shows the holding device in accordance with FIG. 6, along the section VII-VII.

FIG. 1 shows a holding device 1 by means of which a balustrade 3 consisting of two panes of glass 2 is supported between two walls 4 on a ceiling 5. The depiction selected in FIG. 1 is a schematic representation of balustrades 3 of this kind. The design structure of the holding device 1 and the different configuration variants and applications are shown in FIGS. 2 to 7. The same components have identical reference numbers.

FIG. 2 shows that the holding device 1 consists of a U-shaped carrier rail 7 in which the two panes of glass 2 are inserted. The carrier rail 7 can also be configured as an L-shaped support body or as a plate. The two panes of glass 2 are firmly connected together by means of an adhesive foil 6 that is arranged in between them, with the effect that a safety glass results. It is important that the safety glass, in other words one of the two panes of glass 2 is locationally fixed on the carrier rail 7, for example by means of an adhesive 8. Mechanical connection such as fastening screws that penetrate the panes of glass 2 and are supported on the carrier rail 7 can also be used for providing a balustrade 3.

The two panes of glass 2 are fixed onto the carrier rail 7 at the factory, with the effect that these are supplied pre-assembled as a modular unit.

In order for the balustrade 3 to be installed, it is necessary for a holding plate 9 made from metal to be attached to the ceiling 5 by means of fastening screws 10. The holding plate 9 in this case projects beyond the base formed by the ceiling 5, with the effect that the free end 9' of the holding plate 9 projecting from the ceiling 5 can be used as a holding lug or holding web for a hook-in pocket 25 that is formed on the carrier rail 7. The U-shaped hook-in pocket 25 formed on a leg of the carrier rail 7 facing the holding plate exclusively functions as a means of supporting the forces that act horizontally on the holding plate 9 in the form of a loose bearing in the assembled condition. Furthermore, a gap 30 is provided between the horizontally vectored leg of the hook-in pocket 25 and the free end face of the holding plate 9.

The distance between the two inner sides of the hook-in pocket 25 facing one another is a specified distance, therefore it is possible to compensate for play by means of compensating bodies 26. The compensating bodies 26 can be manufactured from metal or a hard material, such as plastic. This means the distance in the horizontal direction between the two inner surfaces of the hook-in pocket 25 and the two outer surfaces of the holding plate 9 can be compensated using the compensating bodies 26; the width of the holding plate 9 can namely vary or have undulations along its length.

A compensating measure of this kind means that the carrier rail 7 is tilted, in other words it runs at an angle from the vertical in the direction of the holding plate 9 and makes linear contact with the holding plate 9. This pre-assemble condition is not desirable for the balustrade 3, however; instead, the balustrade 3 should run perpendicular, in other words precisely vertically. For this purpose, there is a box rail 11 in the lower area of the carrier rail 7 and this box rail 11 is fixed on the holding plate 9 by means of a support element 12 that is shown in the sample embodiment in FIGS. 2 and 3 as a box-shaped rail 14. In this case, the rail 14 is attached to the holding plate 9 by means of two welds 15 running opposite to and parallel with one another, and projects from the holding plate 9 at right angles. The upper side of the rail 14 forms a contact surface 23 with which the underside of the carrier rail 7 makes contact in assembled condition, and is therefore supported in the vertical direction.

A setscrew 16 and a clamping screw 34 is used for forming a fixed bearing, in which the screws run at right angles to the holding plate 9 and their head 16' or 34' is in a non-positive or positive connection with the carrier rail 7, as will be explained in more detail below.

The setscrew 16 passes through a slot-like or round opening 22 worked into the rail 14 and two through-holes 18 and 19 worked into the box rail 11. The opening 22 and the two through-holes 19 and 19 accordingly run flush with one another in the assembled condition.

A rectangular recess 20 is worked into the inside of the box rail 11 between the two through-holes 18 and 19, and a nut 21 is pushed into the recess 20 with the effect that the threaded hole of the nut 21 runs flush with the opening 22 and the two through-holes 18 and 19. As a result, the free end of the setscrew 16 can initially be screwed through the opening 22 and the through-hole 18 into the threaded hole in the nut 21. The through-hole 19 is aligned flush with the threaded hole in the nut 21, therefore the free end of the setscrew can project into this through-hole 19, with the effect that the part of the setscrew 16 projecting out of the box section 11 and the rail 14 can be variably adjusted by moving the setscrew 16 towards the holding plate 9 or away from it.

In this case, the distance between two contact surfaces 21' of the nut 21 that run in parallel with one another is the same distance as the vertical distance of the recess 20, with the effect that the contact surfaces 21' of the nut 21 are in contact with the inner contour of the recess 20. Accordingly, the nut 21 cannot be moved relative to the setscrew 16 when the setscrew 16 is rotated. Furthermore, the nut 21 is held in the horizontal direction in the recess 20 between the through-holes 18 and 19, because the vertical side surfaces of the recess 20 serve as a contact surface for the nut 21 when horizontal forces arise.

The head 16' of the setscrew 16 is pushed into a U-shaped holding pocket 24 that is formed onto the underside of the carrier rail 7. As a result, the setscrew 16 is in a non-positive connection in the horizontal direction with the carrier rail 7, with the effect that horizontal forces can be transmitted to the carrier rail 7 by means of the setscrew 16. As a result, a change in length of the setscrew 16 means that the angle of inclination of the carrier rail 7 can be changed in relation to the holding plate 9 and, therefore, the ceiling 5 and the vertical, this change in angle being dependent on the required inclination.

FIG. 3 shows that a clamping screw 34 is screwed into the box rail at the side next to the setscrew 16. The clamping screw 34 defines the movement possibility of the carrier rail 11, namely in relation to the set distance between the head 16' of the setscrew 16 and the holding plate 9. The clamping screw 34 therefore serves as an additional securing point for the carrier rail 7, with the effect that the contact surface 23 and the and the clamping of the carrier rail 7 by means of the setscrews 16 and the clamping screw 34 form a fixed bearing, because in the assembled condition vertical and horizontally acting forces as well as their torques, by means of which load is applied to the carrier rail 7, are absorbed by this configuration of the bearing and are reliably supported.

A trim 27 can be used to cover the carrier rail 7 in order to conceal it from view.

FIGS. 4*a* and 4*b* show a second sample embodiment of the holding device 1 in accordance with the present invention. They show that the box rail 11 can be attached directly to the holding plate 9 by means of two fixing screws 17, and that the underside of the carrier rail 7 is in contact with the surface 23 of the box rail 11 that is facing the carrier rail 7. If necessary, a rubber plate 33 can be inserted as a damping element between the carrier rail 7 and the box rail 11. The two fixing screws 17 arranged in the lateral area of the box rail 11 are accessible from the outside, and the setscrews 16 and the clamping screws 34 arranged in between can also be turned from the outside, for example using an Allen key, with the effect that the angle of inclination of the carrier rail 7 can be adjusted.

FIGS. 5*a* and 5*b* show a third sample embodiment of the holding device 1. The support element 12 in this case is configured as a continuous strip 13 that is attached to the holding plate 9 by means of the weld 15. The strip 13 forms a right angle in relation to the holding plate 9. This strip 13 has a plurality of openings 22 worked into it, and the fixing screws 17 are inserted into them. The box rail 11 is placed on the surface of the holding strip 13, in order words between the holding strip 13 and the underside of the carrier rail 7. The through-holes 18 and 19 worked into the box rail 11 are now facing the strip 13, with the effect that the through-holes 18 and 19 run in alignment with a hole 28 worked into the strip 13, and the fixing screw 17 can be pushed through this hole 28.

Between the two through-holes 18 and 19, there is the recess 20 into which the nut 21 for holding the fixing screw 17 is pushed. As a result, the box rail 11 is held locationally fixed on the strip 13 by means of the nut 21 and the fixing screw 17 screwed into the nut 21.

The through-holes 18 and 19 accommodating the setscrews 16 and the clamping screw 34 run at right angles to the through-holes 18 and 19 allocated to the fixing screws 17, with the effect that the head 16' of the setscrew 16 or the head 34' of the clamping screw 34 face towards the holding pocket 25 formed on the carrier rail 7 and are pushed into it.

FIGS. 6 and 7 show that the holding device can also be used for supporting a balustrade for a staircase. The carrier rail 7 in this case lies on the surface of the rail 14 which is connect to the holding plate 9 by means of the welds 15. As has already been explained in FIGS. 2 and 3, the setscrew 16 engages in the inside of the box rail 11 and is supported there by means of the nut 21.

The invention claimed is:

1. A holding device (1) by means of which one or more panes of glass (2) forming a balustrade (3) is/are supported on a wall (4) or ceiling (5), the device comprising a carrier rail (7) for holding the panes of glass (2), and a holding plate (9) attached to the ceiling (5) or wall (4) with said carrier rail (7) attached to said holding plate (9) in a horizontal direction by a U-shaped hook-in pocket (25) projecting from said carrier rail (7), a box rail (11) projecting in a direction of said carrier rail (7) and attached to said holding plate (9) by a support element (12), wherein said carrier rail (7) is in contact with the support element (12) when installed, and setscrew means (16) and clamping screw-means (34) project from said box rail (11) toward said carrier rail (7) and are connected to said carrier rail (7) such that a distance between said box rail (11) and said carrier rail (7) can be adjusted by means of said setscrew means (16); and wherein the support element (12) is configured as a selected one of a flat strip (13) and a box-shaped rail (14), with said box rail (11) disposed therein, and the support element is fixed onto said holding plate (9) in selected areas; and wherein two through-holes (18, 19) extending in alignment with one another are disposed in said box rail (11), said setscrew means (16) and a said clamping screw means (34) passing through the through-holes (18, 19), and a rectangular recess (20) is disposed between said two through-holes (18, 19), and a nut (21) is disposed in said recess (20), with said set screw means (16) and said clamping screw means held in said nut (21) in a variably adjustable position by means of a thread.

2. The holding device in accordance with claim 1, wherein a head (34') of said clamping screw means (34) is in contact with an outside surface of said carrier rail (7) and said carrier rail (7) is clamped in a horizontal direction on said holding plate (9) by means of said setscrew means (16) and said clamping screw means (34).

3. The holding device in accordance with claim 2, wherein a fixed bearing is formed by the clamping of said carrier rail (7) by means of said setscrew means (16) and said clamping screw means (34), and by means of supports (23) of said box rail (11), the support element (12) absorbing vertically vectored forces.

4. The holding device in accordance with claim 1, wherein one or more openings (22) are disposed in a wall of the rail (14) facing said carrier rail (7), the openings (22) extending in alignment with said two through-holes (18, 19) of said box rail (11) when the rail (14) is in an installed condition, and one of said setscrew means (16) or said clamping screw means (34) projects from each of the openings.

5. The holding device in accordance with claim 1, wherein a distance between two contact surfaces (21') of said nut (21) that are parallel with one another is dimensioned such that said nut (21) is held so that it cannot rotate in said recess (20) of said box rail (11).

6. The holding device in accordance with claim 1, wherein the strip (13) is provided with one or more holes (28) disposed therein and extending parallel to said holding plate (9), said box rail (11) is disposed on a surface of the element (12) that is facing said carrier rail (7), and one or more threaded holes (29) extend into said box rail (11), a fixing screw (17) is screwed into the corresponding threaded hole (29) of said box rail (11) and is locked on the strip (13) using said fixing screw (17).

7. The holding device in accordance with claim 1, wherein a U-shaped holding pocket (24) is formed on the side of said carrier rail (7) facing towards said box rail (11), with a head (16') of one of said setscrew means (16) inserted into said holding pocket (24) in the installed condition and said clamping screw means (34) pass through said holding pocket (24).

8. The holding device in accordance with claim 1, wherein said box rail (11) or support element (13, 14) projects from said holding plate (9) at a right angle thereto.

9. The holding device in accordance claim 1, wherein a hook-in pocket (25) formed on said carrier rail (7) is connected to said holding plate (9) in an installed condition such that a gap (30) is formed between the inside of said hook-in pocket (25) and an upwardly projected end face of said holding plate (9), and said hook-in pocket (25) is in contact with said holding plate (9) in a horizontal direction either directly or via compensating bodies (26); and a fixing strip (31) or a plurality of holding blocks is welded onto a free end face of said holding plate (9) that is assigned to said hook-in pocket (25), with said fixing strip (31) or a plurality of holding blocks extending parallel to said carrier rail (7) and at a distance therefrom and with said hook-in pocket (25) of said carrier rail (7) attached to said fixing strip (31) or plurality of holding blocks in the installed condition.

10. The holding device in accordance with claim 9, wherein a vertical plane formed by said fixing strip (31) or the holding blocks is at a distance from a plane formed by said holding plate (9) and the compensating bodies (26) enable a selected amount of play to be set.

* * * * *